United States Patent [19]

Hart

[11] 3,972,150

[45] Aug. 3, 1976

[54] GUNS FOR FORMING JETS OF PARTICULATE MATERIAL

[76] Inventor: Bernard Eaton Hart, Rosebank, Stoford Nr. Salisbury Wiltshire, England

[22] Filed: May 27, 1975

[21] Appl. No.: 580,967

[30] Foreign Application Priority Data

June 5, 1974 United Kingdom ..... 25003/74

[52] U.S. Cl. ..... 51/11; 239/314; 239/336; 239/379; 239/422; 239/424.5; 239/DIG. 7

[51] Int. Cl.[2] ..... B24C 3/00; B05B 7/08

[58] Field of Search ..... 239/336, 379, 340, 418, 239/422, 423, 314, 424, 424.5, DIG. 7; 51/11, 12

[56] References Cited

UNITED STATES PATENTS

| | | | |
|---|---|---|---|
| 409,751 | 8/1889 | Mathewson | 51/11 X |
| 1,313,605 | 8/1919 | Reynolds | 239/424.5 |
| 1,770,011 | 7/1930 | Poston | 239/336 X |
| 1,881,345 | 10/1932 | Beatty et al. | 239/422 |
| 2,290,979 | 7/1942 | Lucc | 51/11 |
| 3,828,478 | 8/1974 | Bemis | 51/11 |
| 3,858,358 | 1/1975 | Stachowiak et al. | 51/11 X |

FOREIGN PATENTS OR APPLICATIONS

| | | | |
|---|---|---|---|
| 568,572 | 6/1958 | Belgium | 239/422 |
| 40,722 | 9/1887 | Germany | 51/11 |
| 478,882 | 1/1938 | United Kingdom | 239/336 |

*Primary Examiner*—Robert S. Ward, Jr.
*Attorney, Agent, or Firm*—Brisebois & Kruger

[57] ABSTRACT

A gun for forming a jet of particulate material and liquid comprises a body having a tapering bore therein connected by its longer end to a supply of fluidized particulate material and communicating by its other end with an opening in the body through which a tapering jet of fluidized particulate material will issue, and a pair of jet forming means for forming opposed jets of high pressure liquid which will converge and intersect beyond the body and in the path of the jet of particulate material to form a high energy jet of particulate material and liquid.

4 Claims, 5 Drawing Figures

GUNS FOR FORMING JETS OF PARTICULATE MATERIAL

The present invention relates to improvements in guns for forming jets of particulate abrasive material and liquid, e.g. sand or grit and water.

According to one aspect of the present invention there is provided a gun for forming a jet of particulate material and liquid comprising a body having a bore for connection to a supply of particulate material and communicating with an opening in the body at which a jet of particulate material will issue, and means for forming a pair of opposed jets of high pressure liquid which will converge and intersect beyond the opening of the body in the path of the jet of particulate material issuing from the opening.

Advantageously each jet forming means comprises nozzles associated with a guide surface which will cause a generally round section jet from the nozzle to be flattened.

In the preferred embodiment the guide surfaces are formed on the body.

The present invention will be more fully understood from the following description of an embodiment thereof, given by way of example only, with reference to the accompanying drawings, in which.

Figure 1:
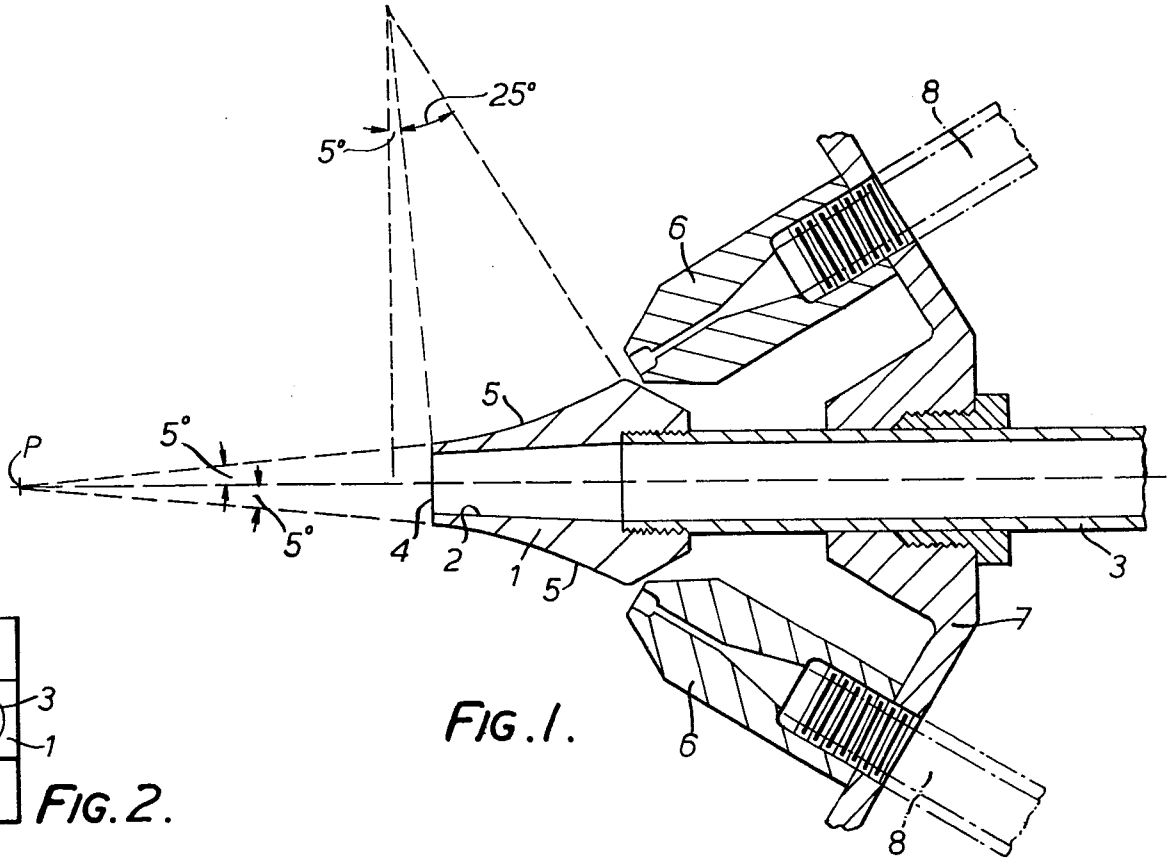
FIG. 1 is a section through an embodiment of gun according to the present invention, showing the body and jet forming means.
Figure 2:
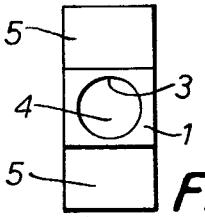
FIG. 2 is an end view of the body of the gun of FIG. 1.

As shown in FIGS. 1 and 2, the gun comprises a body 1 having a tapered bore 2 connected at one end to a metal tube 3 through which particulate abrasive material, preferably mixed with a liquid such as water, is supplied to the bore 2, the particulate material issuing through the other open end 4 of the bore as a tapering jet. As shown, the body is generally rectangular in transverse section and has two opposite surfaces 5 which are arcuate in a plane including the axis of the bore 2. These surfaces 5 form guide surfaces for high pressure jets of liquid, e.g. water, issuing from nozzles 6 which are located rearwardly of the surfaces 5 and direct jets of water tangentially against the rearward ends of the guide surfaces. The jets of water issuing from the nozzles 6 are generally circular in section and, in flowing over the arcuate guide surfaces 5, are flattened. The tangents to the forward ends of the guide surfaces are mutually inclined at a small angle so that the flattened jets therefrom intersect at a point P on the axis of the bore 2 and therefore on the axis of the jet of particulate material issuing from the bore.

Figure 4:
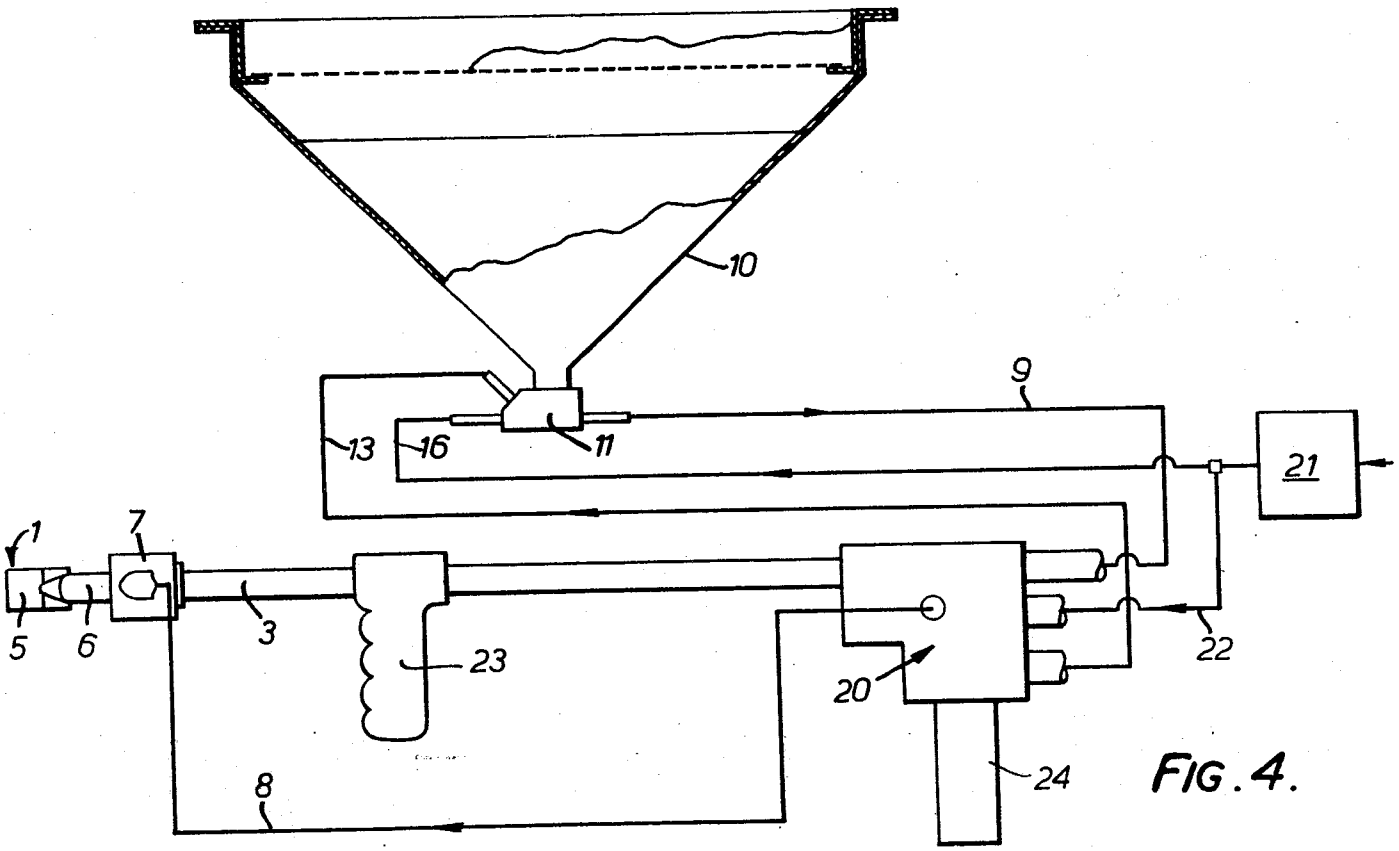
FIG. 4 is a diagrammatic view partly in section of an assembly including the gun of FIG. 1.

As shown the nozzles 6 are mounted on a support 7 on tube 3. In a modification the nozzles are formed integrally with the body 1. The nozzles 6 are connected by flexible hoses 8 to the outlet of a valve 20 (FIG. 4) e.g. as described in British pat. No. 1,403,528, and which is also mounted on tube 3. The inlet of the valve is connected to the outlet of a high pressure pump 21, e.g. as described in U.S. pat. No. 3,859,011, via a flexible hose 22.

Figure 3:
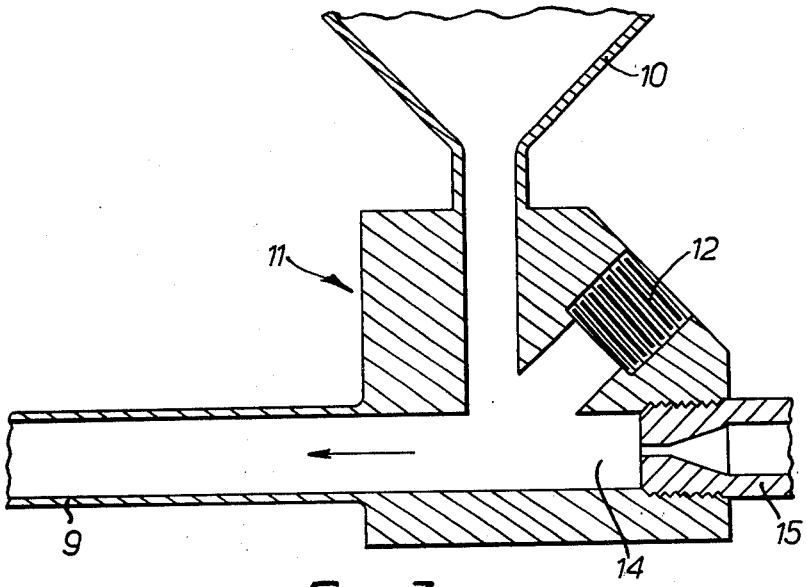
FIG. 3 is a section through the outlet of a hopper for particulate material to be coupled to the gun of FIG. 1.
Figure 5:
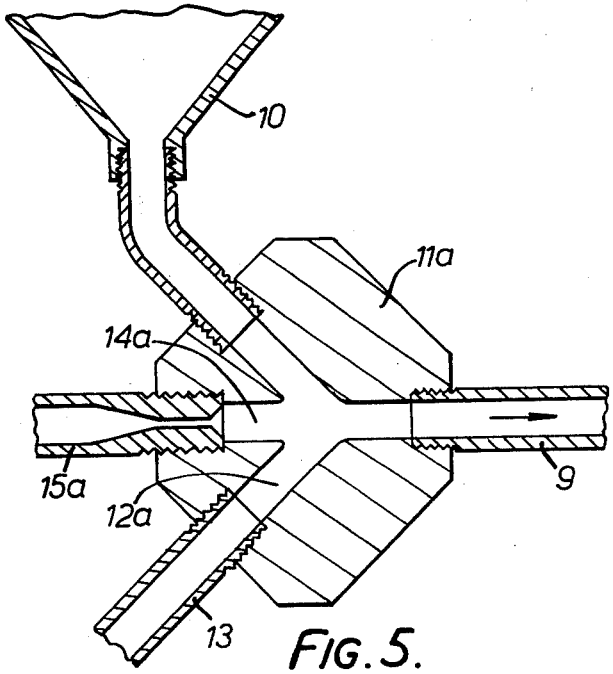
FIG. 5 is a section through a modified hopper outlet.

The tube 3 is connected by a flexible hose 9 to a hopper 10 (FIG. 3 and 4) for particulate material and water, whose outlet 11 is coupled via passage 12 and hose 13 to an outlet of the valve and is coupled via passage 14, nozzle 15 and hose 16 to a bleed from the pump outlet, as is more fully described in British pat. No. 1,424,896. The connections to the hopper outlet 11 are such that, when the gun is in use, the particulate material and water mixture from the hopper is energised by a high kinetic energy jet of water from nozzle 15 and, when the gun is not in use, the water otherwise supplied to nozzles 6 is supplied to passage 12 to close off the hopper outlet and to clear the flexible hose 9 and tube 3 of particulate material. Some water from passage 12 may enter the hopper. FIG. 5 shows a modified form 11a of the hopper outlet 11 in which corresponding parts are indicated by the same reference numerals with a suffix a. As clearly shown in FIG. 5, the passage 12 of FIG. 3 which leads to the hose 13 has been replaced by a passage **12*a*, which occupies a different position relative to the hopper. Similarly the nozzle 15 and passage 14 of the FIG. 3 embodiment have been replaced by the nozzle 15*a* and passage 14*a*. A bend has also been introduced in the outlet from the hopper. Otherwise the embodiments of FIGS. 3 and 5** are substantially the same.

The tube 3 is provided with a handle 23 to be grasped by the operator, the valve providing a second handle 24 to be grasped by the operator. The tube 3 can be of variable length to space the point P a variable distance from the operator.

In use of the above described gun assembly, the particulate material and water mixture issuing from the end of the bore 2 is picked up by the intersecting water jets at point P and formed into a flat high kinetic energy jet of particulate material and water which can be used for, e.g. cleaning ships hulls and buildings.

Because the high kinetic energy jet of particulate material and water is formed beyond the end of the gun, wear on the gun components is reduced to a minimum. The dimensions of the jet are controlled and variable by changing the radius of curvature of guide surfaces 5 or the angles subtended by each surface.

Because the gun operates on a mixture of particulate material and liquid, the particulate material may be sand or another cheap silica based material, which materials are prohibited in air powered blasting because of the danger of silicosis.

While the gun has been described as being supplied with a particulate material and water mixture, it will be appreciated that it could, alternatively be supplied with a particulate material fluidised and energised by a high pressure air jet at the hopper outlet 11 instead of the high pressure water jet.

It will be appreciated that, while the water jets from the nozzles 6 will tend to create a vacuum at the end of the bore 2, since this zone is open to atmosphere laterally of the jets, it is ineffective for drawing the particulate material from the bore 2. As a consequence the particulate material supplied to the bore 2 must be energised. To render the vacuum more effective, the body 1 may be provided with lateral extensions on each side of the end of the bore which, in effect, close or partly close the zone to be evacuated so that the vacuum produced can be used for drawing the particulate material from the bore, as for example in the gun described in British Pat. No. 1,403,528, and the particulate material supplied to the bore 2 need not be energised. However, even under these circumstances, the particulate material supplied to the bore can with advantage be energised for reasons set out in British pat. No. 1,424,896.

Finally the guide surfaces 5 need not be provided on the body but may form part of the nozzles 6, as for example in U.S. Pat. No. 2,530,671.

In a preferred embodiment of the gun illustrated in FIGS. 1 and 2, the water supplied by the pump is at a pressure of between 2,000 and 5,000 psi. The area of the nozzle 15 to the sum of the areas of nozzles 6 are in the ratio 0.1 to 0.15, i.e. between 10 and 15 percent of the pump output is fed to the nozzle 15 at the hopper outlet.

The radius of the guide surfaces 5 is approximately 3 inches, the angle subtended thereby is approximately 30° and the angle between the water jets leaving the guide surfaces is approximately 10° and the point P is approximately 3 inches beyond the end of the body 1.

What is claimed is:

1. A gun for forming an abrasive jet of particulate abrasive material and liquid comprising:

a body defining a bore therethrough, said bore having an axis and an opening at one end;

means for connecting the other end of said bore to a conduit for supplying particulate abrasive material to said bore for ejection from said opening in the form of a jet of particulate abrasive material;

a pair of nozzles which, when connected to a supply of high pressure liquid, provide a pair of high pressure liquid jets, each nozzle being shaped to provide a generally circular-section jets of liquid;

means for connecting each nozzle to a supply of high pressure liquid;

means for mounting said nozzles symmetrically relative to said axis of said bore with axes of said nozzles in a common plane including said axis of said bore and inclined towards said axis of said bore in the direction of flow of particulate material through said bore;

a pair of guide surfaces each arranged in the path of the liquid jet from a respective one of said nozzles and symmetrically positioned relative to said axis of said bore, each guide surface being formed on an external surface of said body and having a part-cylindrical shape, the axes of the cylinders of said guide surfaces being parallel and perpendicular to said axis of said bore and disposed in a plane downstream of said opening of said bore, the central diametral plane of each part-cylindrical surface including said axis of the respective one of said nozzles, each said guide surface being so positioned relative to the respective nozzle that the jet issuing from said respective nozzle will impinge tangentially on said guide surface and said liquid jets will be flattened by said guide surfaces and will converge to intersect along a line parallel to said axes of said cylinders and on said axis of said bore to flatten the jet of particulate abrasive material issuing from said bore.

2. A gun as claimed in claim 1, wherein the bore in the body is tapered in the direction of the opening.

3. A gun assembly including a gun as claimed in claim 1, a valve having an inlet for connection to a supply of high pressure liquid and outlet means for connection to the jet forming means, and a container for particulate material having an outlet connected to the bore of the gun and adapted for connection to a supply of high pressure fluid.

4. A gun assembly according to claim 3 wherein the valve includes a bypass outlet connected to the hopper outlet for supplying liquid thereto to thereby close the hopper outlet, the valve being operable to direct liquid from the outlet means to the bypass outlet.

* * * * *